US007710268B2

(12) United States Patent
Schoen et al.

(10) Patent No.: US 7,710,268 B2
(45) Date of Patent: May 4, 2010

(54) SYSTEM AND METHOD TO PROTECT PERSONAL PROPERTY

(75) Inventors: Neil C. Schoen, Montgomery Village, MD (US); Wendy A. Schoen, Montgomery Village, MD (US)

(73) Assignee: The Boeing Company, Irvine, CA (US)

( * ) Notice: Subject to any disclaimer, the term of this patent is extended or adjusted under 35 U.S.C. 154(b) by 510 days.

(21) Appl. No.: 11/533,426

(22) Filed: Sep. 20, 2006

(65) Prior Publication Data

US 2008/0074265 A1 Mar. 27, 2008

(51) Int. Cl.
*G08B 13/14* (2006.01)

(52) U.S. Cl. ..... 340/572.1; 726/16; 235/375

(58) Field of Classification Search ... 340/572.1–572.9; 235/375; 726/16, 26
See application file for complete search history.

(56) References Cited

U.S. PATENT DOCUMENTS 6,028,551 A 2/2000 Schoen et al.
6,285,318 B1 9/2001 Schoen et al.
6,700,533 B1 * 3/2004 Werb et al. ..... 342/357.07
7,248,933 B2 * 7/2007 Wildman ..... 700/90
7,420,465 B2 * 9/2008 Ritter ..... 340/539.32
2002/0080036 A1 * 6/2002 Rabanne et al. ..... 340/573.1
2002/0126010 A1 * 9/2002 Trimble et al. ..... 340/568.1
2003/0034887 A1 * 2/2003 Crabtree et al. ..... 340/539
2003/0063003 A1 * 4/2003 Bero et al. ..... 340/573.1
2005/0134459 A1 * 6/2005 Glick et al. ..... 340/572.1
2005/0195080 A1 9/2005 Ng et al.
2007/0192869 A1 * 8/2007 Garfinkle ..... 726/26

* cited by examiner

*Primary Examiner*—Davetta W Goins
*Assistant Examiner*—Edny Labbees
(74) *Attorney, Agent, or Firm*—Charles L. Moore; Moore & Van Allen, PLLC

(57) ABSTRACT

A system to protect personal property may include an electronic tag associable with a personal property item. The system may also include a controller adapted to wirelessly communicate with the electronic tag to determine a status of the electronic tag to protect the personal property item from loss or theft.

30 Claims, 5 Drawing Sheets

SYSTEM AND METHOD TO PROTECT PERSONAL PROPERTY

BACKGROUND OF THE INVENTION

The present invention relates to protecting personal property from loss or theft and more particularly to a system and method to protect personal property.

There are currently no reliable means to protect an individual's personal property, such as a traveler's personal property, against theft or loss, other than constant vigilance. In the example of a traveler, personal property is vulnerable to theft or loss when enroute to or from a principle mode of transportation, such as an airplane, train, taxi or the like. Frequently, distractions arise that may cause an individual or traveler to turn his attention and focus away from some of his possessions. During this time period a theft of some or all of the individual's belongings could be easily accomplished by professional thieves, or some person could inadvertently take the wrong bag or other personal property item. Examples include baggage placed on the curb and stolen or inadvertently taken while out of sight of a traveler paying cab fare, or pickpockets stealing a traveler's wallet or purse in a crowded subway, bus terminal or airport. Another frequent scenario ending in loss of the traveler's property may entail valuable objects left behind when departing a mode of transportation. For example, leaving behind a laptop computer, a valuable piece of clothing or other item in an overhead baggage area or seat back on an airplane or train.

BRIEF SUMMARY OF THE INVENTION

In accordance with an embodiment of the present invention, a system to protect personal property may include an electronic tag associable with a personal property item. The system may also include a controller adapted to wirelessly communicate with the electronic tag to determine a status of the electronic tag to protect the personal property item from loss or theft.

In accordance with another embodiment of the present invention, an electronic tag for use in a personal property protection system may include a unique identification code to distinguish the electronic tag from other electronic tags. The electronic tag may also include a device or component to determine a status of the electronic tag. The electronic tag may also include a device or component to report a status of the electronic tag to a controller in the personal property protection system.

In accordance with another embodiment of the present invention, a controller for use in a personal property protection system may include a communications device to wirelessly communicate with an electronic tag to determine a status of the electronic tag to protect a personal property item associated with the electronic tag from loss or theft. The controller may also include a processor to determine a status of the electronic tag based on at least one of information received from the electronic tag and an absence of a signal from the electronic tag after an interrogation signal.

In accordance with another embodiment of the present invention, a method to protect personal property may include determining a status of an electronic tag associated with a personal property item. The method may also include activating an alarm in response to the status of the electronic tag being in a predetermined condition.

In accordance with another embodiment of the present invention, a computer program product to protect personal property from theft or loss may include a computer usable medium having computer usable program code embodied therewith. The computer usable medium may include computer usable program code configured to determine a status of an electronic tag associated with a personal property item. The computer usable medium may also include computer usable program code configured to activate an alarm in response to the status of the electronic tag being in a predetermined condition.

Other aspects and features of the present invention, as defined solely by the claims, will become apparent to those ordinarily skilled in the art upon review of the following non-limited detailed description of the invention in conjunction with the accompanying figures.

DETAILED DESCRIPTION OF THE INVENTION

Figure 1:
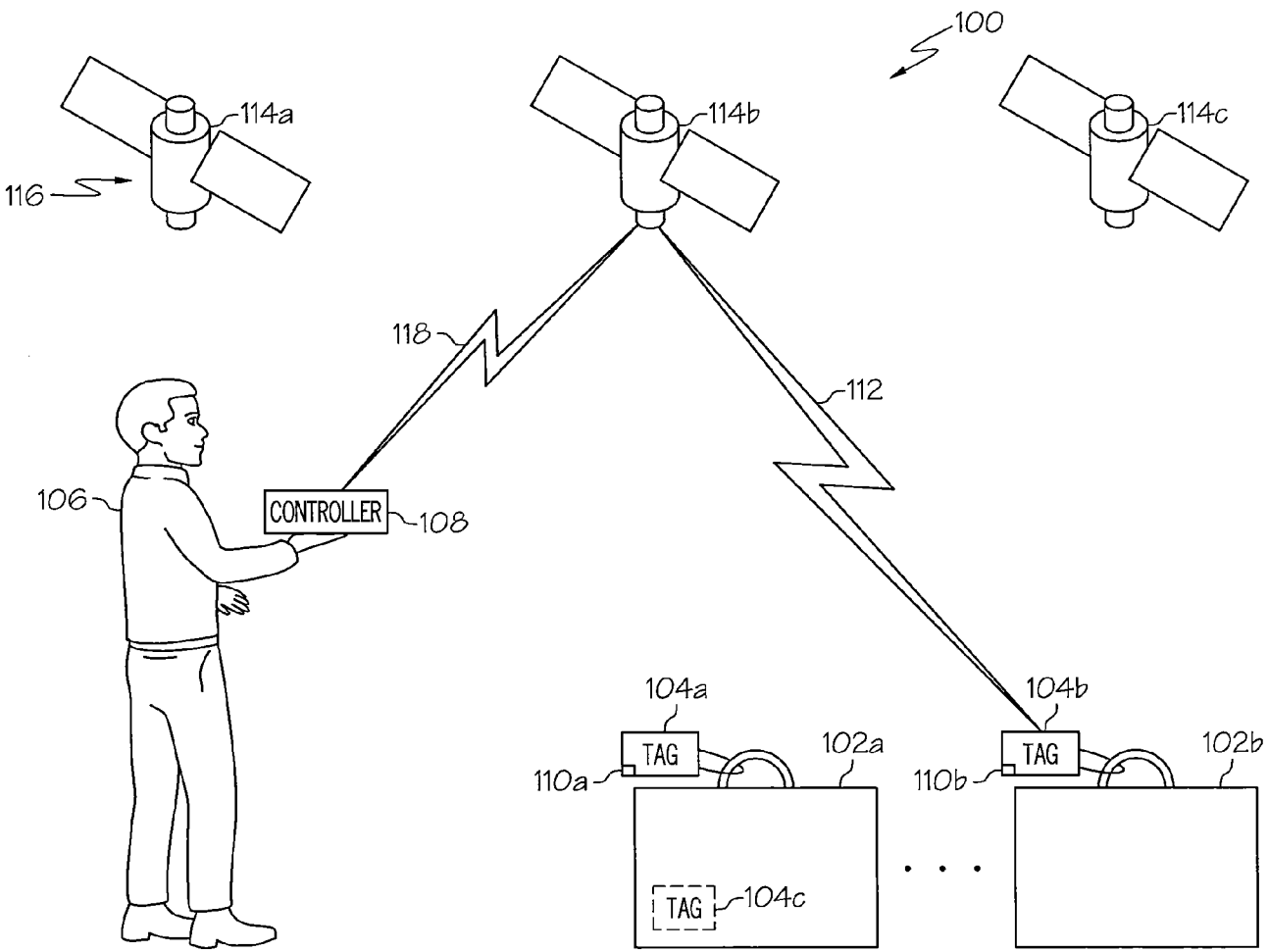
FIG. 1 is a block diagram of an example of a system to protect personal property from theft or loss in accordance with an embodiment of the present invention.

The following detailed description of embodiments refers to the accompanying drawings, which illustrate specific embodiments of the invention. Other embodiments having different structures and operations do not depart from the scope of the present invention.

As will be appreciated by one of skill in the art, the present invention may be embodied as a method, system, or computer program product. Accordingly, portions of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-useable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present invention may be written in an object oriented programming language such as Java, Smalltalk, C++ or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

FIG. 1 is a block diagram of an example of a system 100 to protect personal property 102 from theft or loss in accordance with an embodiment of the present invention. The system 100 may include one or more electronic tags 104 that are each associable with a personal property item 102. An example of an electronic tag 104 that may be used with the system 100 will be described in more detail with reference to FIG. 2. The personal property item 102 may be any personal property item that an individual 106 wants to protect from theft or loss or otherwise wants to be able to determine the whereabouts. Examples of personal property may include but is not necessarily limited to luggage, a lap top computer, articles of clothing, a purse or wallet or similar items. The present invention may also be used to keep track of younger children or pets.

The electronic tag 104 may be attached to the personal property item 102 by any sort of means, such as a strap, clip, pin or the like. For example, the electronic tags 104*a* and 104*b* may be attached to a handle of a bag or luggage by a strap similar to a regular identification tag. In another embodiment of the present invention the electronic tag 104, such as electronic tag 104*c*, may be disposed within the personal property item 102*a*. This may provide additional security in that the tag 104*c* would not be subject to removal by a thief and the tag may be less likely to be damaged than if exposed on the exterior of the personal property item 102*a*. Additionally, the electronic tag 104*c* may have special tracking and location features described in more detail herein that may result in the size of the packaging of the tag making it impractical to locate or attach the tag 104 to the exterior of the personal property item 104.

In at least one embodiment of the present invention, the electronic tag 104 may be small and thin enough to simply be inserted in the personal property item 104, such as in a pursue, credit card slot in a wallet, identification slot on a bag or luggage or the like. The electronic tag 104 may be adapted to provide notification to a user or traveler 106 or to a controller device 108 in possession of the user when the personal property item 102 associated with the tag 104 leaves an immediate proximity of the user or traveler 106 and/or the personal property item 102 associated with the tag undergoes movement or motion, both described in more detail herein.

As mentioned above, the system 100 may also include a controller 108. The controller 108 may be adapted to wirelessly communicate with each of the electronic tags 104 to determine a status of each electronic tag 104 to protect the associated personal property item 104 from loss or theft. Each electronic tag 104 may have a unique identification code 110 or the like to distinguish it from other electronic tags 104 operating in the system 100. The controller 108 is kept in a secure place by the user, such as in a pocket separate from any personal item to be protected, clipped on a belt similar to a cell phone, in a purse or other secure place.

In another embodiment of the present invention, the electronic tag 104 may be adapted to transmit signals 112 to a satellite 114 or constellation 116 of satellites. The signals 112 may include information or data to indicate a location of the tag 104 and/or provide tracking information after the tag 104 is out of range of the controller 108. The location information may be global positioning system (GPS) location information or similar location and tracking information. The satellite 114 may then transmit a signal 118 including the location and/or tracking information to the controller 108, to law enforcement, a commercial security service or the like. The signals 112 and 118 may also be transmitted to and from the satellite 114 via an earth station (not shown) in FIG. 1. The satellites 114 may be a class of communications satellites, such as the Iridium system or a similar system, or a constellation of satellites similar to the GPS constellation of satellites with a capability to receive as well as transmit signals.

Figure 2:
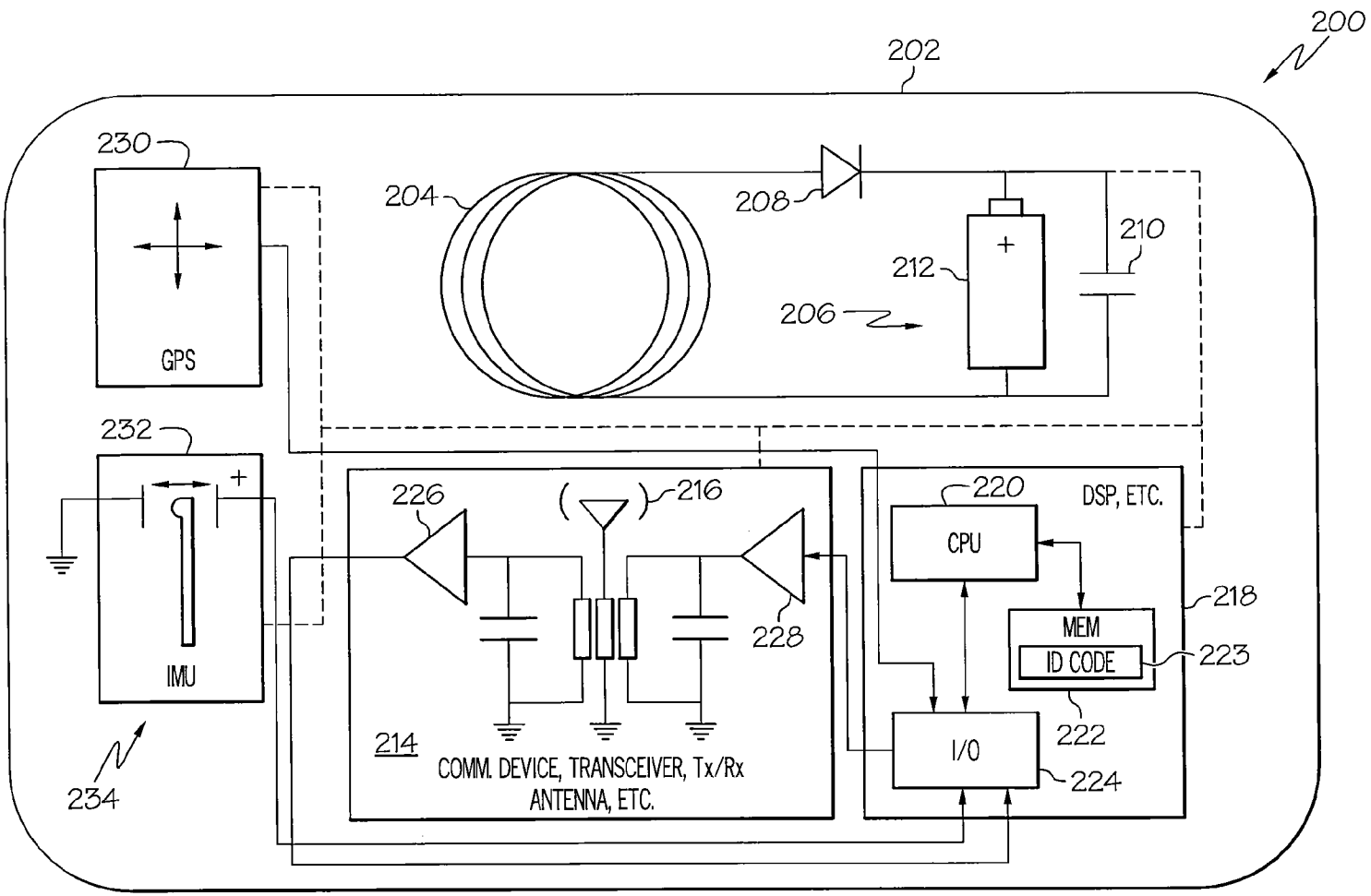
FIG. 2 is a schematic diagram of an example of an electronic personal property protection tag, transponder or the like in accordance with an embodiment of the present invention.

FIG. 2 is a schematic diagram of an example of an electronic personal property protection tag 200, transponder or the like in accordance with an embodiment of the present invention. The electronic tag 200 may be used for the electronic tag 104 in FIG. 1. The electronic tag 200 may be a radio frequency identification (RFID) tag or transponder, or in some embodiments of the present invention, a component of the electronic tag 200 may be an RFID tag or transponder. The components of the electronic tag 200 may vary depending upon the application of the tag and the particular functions that are desired to be performed, such as providing location information, geographical coordinate information or other status information.

The electronic tag 200 may include a housing 202 to protect the internal components of the tag 200. The entire component structure of the electronic tag 200 may be encapsulated in a "smart" laminated card device, such as housing 202, similar to that used for radio frequency identification (RFID) tags or similar devices.

The electronic tag 200 may also include a power reception loop antenna 204. The power reception loop antenna 204 may include a sufficient number of loops to receive a predetermined amount of electromagnetic radiation or energy from a controller, such as controller 108 in FIG. 1, to power the electronic tag 200 to perform the operations and functions described herein.

The power reception loop antenna 204 may be coupled to an energy storage component 206. The antenna 204 may collect radio frequency (RF) energy radiated by the controller (controller 108 in FIG. 1). The RF energy may be rectified and stored in the energy storage component 206 for use in transmissions back to the controller with tag status information. The loop antenna 204 may be coupled to the energy storage component 206 by a diode 208 to rectify the energy signal and to permit electrical current to only flow in one direction and to prevent electrical power from being dissipated by the power reception loop antenna 204. The energy storage component 206 may include a capacitor arrangement 210 for energy storage for short periods of time necessary for operation of the components of the tag 200 before receiving additional energy in a subsequent power signal transmission from the controller.

In another embodiment of the present invention, the energy storage component 206 may include a battery 212. The battery 212 may be in lieu of the capacitor arrangement 210 or may be in addition to the capacitor arrangement 210 for additional power reserves. The battery 212 may be a high power miniature battery that may be charged by the power signal transmitted by the system controller. The battery 212 may be provided in those electronic tags 200 where size may not be of importance, such as in association with luggage. In other applications where size may be of significance, such as placing the electronic tag 200 in a credit card slot of a wallet or the like, the size of the tag 200 may be able to be reduced by eliminating the battery 212.

The electronic tag 200 may also include a communications device 214. The communications device 214 may be any type of short-range, low power wireless communications device. The communications device 214 may be part of an RFID tag or transponder. The communications device 214 may also be Bluetooth-type transceiver, an ultrasonic transceiver, infrared transceiver or the like for wireless communications with a controller, such as controller 108 in FIG. 1. The communications device 214 may have sufficient power and/or may include a loop antenna 216 with a sufficient number of loops to maintain contact with a system controller, such as controller 108 in FIG. 1, over reasonable distances to alert the user as described herein and to allow recovery of any lost or stolen item, preferably before such item is out of sight. The communications device 214 may also be adapted to transmit signals including location or tracking information to a satellite or constellation of satellites, such as satellites 114 in FIG. 1, or to an earth station for communication with the satellite, similar to that described with respect to FIG. 1. Alternatively, the electronic tag 200 may include another communications device to transmit signals including location and/or tracking information to the satellite or constellation of satellites.

The electronic tag 200 may also include a processor 218, digital signal processor (DSP) or the like. Signals received by the communications device 214 and antenna 216 may be fed to the processor or DSP 218 for processing. The processor 218 may be programmed to determine a status of the electronic tag 200. The processor 218 may include a central processing unit (CPU) 220, a memory 222 and an input/output (I/O) module or unit 224. The CPU 220 may control overall operation of the electronic tag 200, such as determining a status of the tag 200 as described in more detail herein. The memory 222 may store a unique identification code 223 to distinguish the electronic tag 200 from other electronic tags as previously discussed. The memory 222 may also store data structures or algorithms for operation by the CPU 220, such as to determine the status of the tag 200, to store information related to the status of the electronic tag 200 or other data related to operation of the tag 200.

The I/O module 224 may receive signals from the communications device 214 or antenna 216 via an amplifier 226. The signals may then be processed by the CPU 220. Another amplifier 228 may couple the I/O module 224 of the DSP 218 to the communications antenna 216. The amplifier 228 may provide signal power to allow transmission of digital signals stored in the tag memory 222 via the antenna 216. The digital signals may contain status information including location information of the tag 200.

The electronic tag 200 may also include at least one of a Global Positioning System (GPS) 230 and a motion detector or sensor 232 to detect motion or movement of the tag 200 or an item associated with the tag 200. The motion detector 232 may be an Inertial Measurement Unit (IMU) or other type motion sensor or detector device. The GPS 230 and/or IMU 232 may determine a coordinate location of the tag 200 or other movement or location information relative to the tag 200. The GPS 230 and motion sensor 232 or IMU may be coupled to the I/O unit 224 of the processor 218. The GPS 230 and/or motion sensor 232 or IMU, communications device 214 and the processor or DSP 218 may define a device 234 to determine at least one of a group including a proximity of the electronic tag 200 to a controller, such as controller 108 in FIG. 1, the electronic tag 200 being out of communications range of the controller, motion of the electronic tag 200, a direction of motion of the electronic tag 200 relative to the controller, a direction of motion of the electronic tag 200 relative to the controller or other information related to a status of the electronic tag to prevent loss or theft of an item associated with the electronic tag and to facilitate recovery of the item under such circumstances.

The GPS system 230 may require a larger tag or housing 202 and may not operate in all environments, for example in circumstances where the GPS 230 cannot access the GPS satellites or cannot access the requisite number of satellites for global positioning. In another embodiment of the present invention, the GPS system 230 may be an "inverse" GPS system or the like that may allow transmitted signals to reach a receiver similar to those applicable to Wireless Fidelity ("Wi-Fi") or wireless local area network (WLAN) or similar protocols. An example of an inverse GPS system is described in U.S. Pat. No. 6,028,551 entitled "Micro-Miniature Beacon Transmit-only Geo-Location Emergency System for Personal Security, granted Feb. 22, 2000 to Neil Charles Schoen and Wendy Ann Schoen and U.S. Pat. No. 6,285,318 which is a continuation-in-part of U.S. Pat. No. 6,028,551, issued Sep. 4, 2001 and has the same title and inventors. GPS system 230 or IMU 234 may also be adapted to transmit signals including location and tracking information to a satellite or constellation of satellites similar to that previously described.

The different components of the electronic tag 200 may be formed as discrete components or some or all of the different components may be formed as an integrated single chip or microchip.

Figure 3:
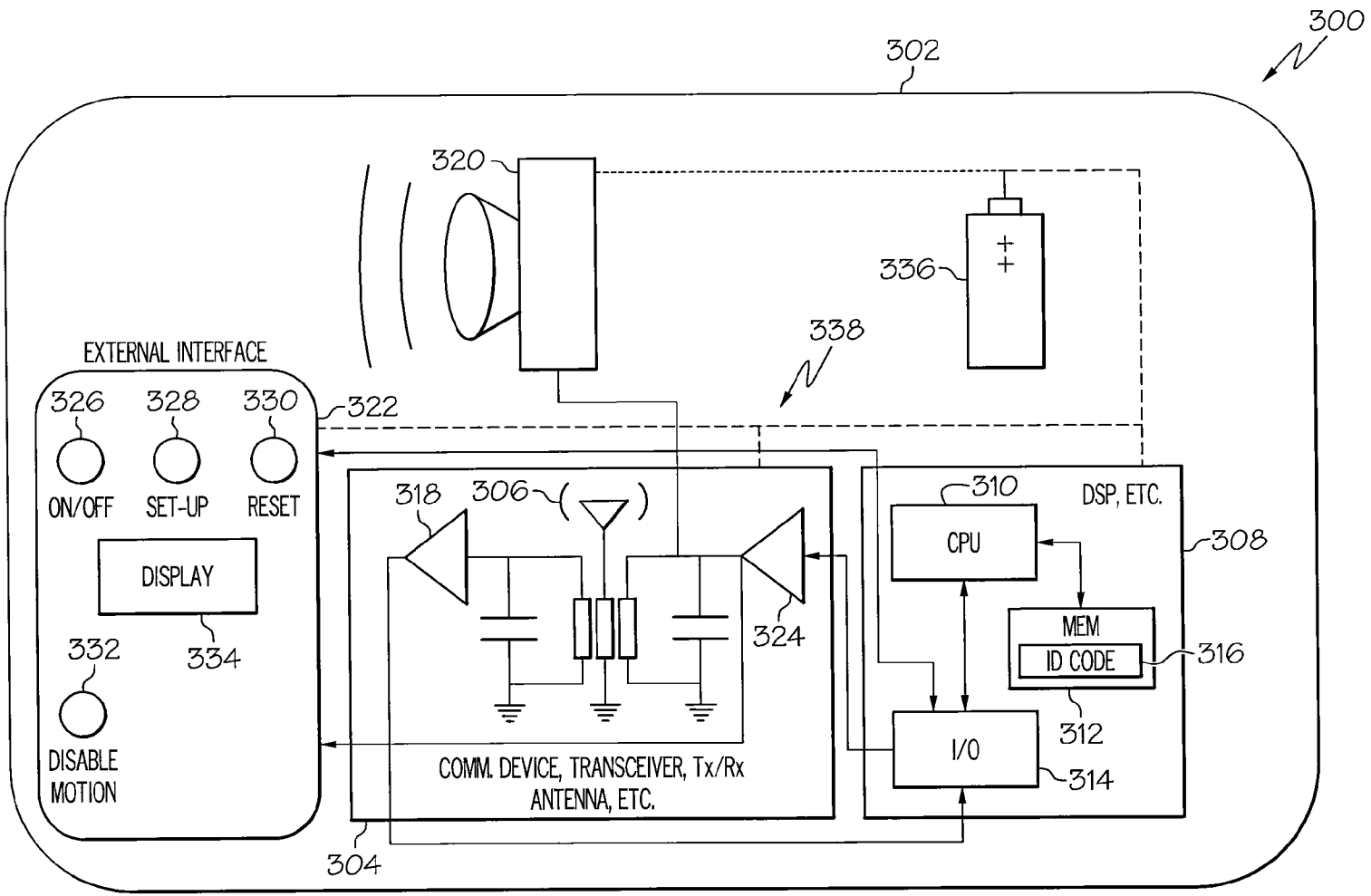
FIG. 3 is a schematic diagram of an example of a personal property protection controller in accordance with an embodiment of the present invention.

FIG. 3 is a schematic diagram of an example of a personal property protection controller 300 in accordance with an embodiment of the present invention. The controller 300 may be used for the controller 108 of FIG. 1. The components of the controller 300 may be contained in a housing 302 to protect the internal components.

The controller 300 may include a communications device 304 to communicate with an electronic tag or tags similar to the tag 200 in FIG. 2. The communications device 304 may include an antenna 306 to transmit and receive signals from the electronic tag or tags. The antenna 306 may be a loop antenna or other type antenna capable of communicating with the electronic tags. The communications device 304 may be an RFID reader, a Bluetooth type transceiver, an ultrasonic transceiver, an infrared transceiver or similar device for communicating with the electronic tags. The means of communication or communications devices of the controller 300 and the electronic tags (tags 200 in FIG. 2) needs to be compatible or capable of communication with one another. For example, the controller 300 and electronic tags 200 should operate on the same frequencies, use the same protocols for communications and the like.

The controller 300 may also include a processor 308 to determine a status of the electronic tag or tags. The processor 308 may be a digital signal processor or the like. The status of the electronic tags may be based on information from the tags. The processor 308 may determine the status of the tags in response to at least one of a signal received from each of the electronic tags or an absence or failure to receive a response signal from each of the electronic tags after an interrogation signal.

The processor 308 may include a central processing unit (CPU) 310, a memory 312 and an input/output (I/O) module or unit 314. The CPU 310 may control the overall operation of the controller 300 and determine the status of the associated electronic tags based on information received from the electronic tags. The memory 312 may store identification codes 316 for each of the electronic tags associated with the controller 300. The memory 312 may also store a status of each associated electronic tag. The memory may also store data structures, algorithms or the like operable on the CPU 310 to control operation of the controller 300 and to determine the status of each associated electronic tag.

The I/O module 314 may be coupled to the communications device 304 by an amplifier 318 that may be part of the communications device 304. The I/O module 314 may also be coupled to an audio alarm 320 and to an external interface 322 for operation and control of the controller 300 by a user. The audio alarm 320 may be a miniature speaker or any type of device capable of emitting an audible alarm or signal to the user. The I/O module 314 may be coupled to the audio alarm 320 by an amplifier 324 to drive the audio alarm 320. The audio alarm 320 may be capable of generating an alarm of a sufficient decibel level to be heard by the user or traveler if the controller 300 is contained in a pocket, purse or the like of the user.

The external interface or user interface 322 may include an "ON/OFF" switch 326 to turn the controller 300 on and off. The external interface 322 may also include a "SET-UP" switch 328 or button to set up the controller 300 and any associated tags for protecting items associated with each of the tags. An example of setting up a system, such as the system 100, will be described with reference to FIG. 4.

The external interface 322 may also include a "RESET" switch 330 or button to reset the controller after an alarm condition. The external interface 322 may also include a "DISABLE MOTION" switch 332, button or the like to disable or ignore any alarms caused by a motion sensor or detection of motion of any of the electronic tags associated with the controller 300. The controller 300 may merely ignore signals received from any associated tag indicating a motion condition or alarm, or a disable signal may be sent from the controller 300 to each tag or to a selected tag or tags to disable the motion detection devices or sensors of the tag or tags. The "DISABLE MOTION" switch 332 may be activated when the user himself or someone authorized by the user or traveler is handling or moving an item associated with a particular tag or tags to prevent false alarms.

The external interface 322 may also include a display 334 to present a status of each electronic tag associated with the controller 300. The status of an electronic tag may include at least one of a range indication of the electronic tag or distance from the controller 300, a location of the electronic tag, a direction of motion of the electronic tag or other information related to the status of the tag or tags. The display 334 may also indicate that the "DISABLE MOTION" switch 332 or feature is active for a particular tag or tags. The display 332 may also present a visual alarm condition in addition to the audio alarm 320.

The controller 300 may also include a battery 336 to store energy for powering the controller 300. As previously discussed, the controller 300 may transmit a signal to also power each electronic tag associated with the controller 300.

The components of the controller 300 may be formed as discrete components or formed as an integrated chip or microchip. The communications device 304 and the processor 308 of the controller 300 may be similar to the communications device 214 and processor 218 of the electronic tag 200. The different elements of the controller 300 may define a device or module 338 to access a stored status of an electronic tag to determine if an alarm condition exists. For example, the controller 300 may periodically transmit an interrogation signal to each associated electronic tag. A status of each tag that may be stored in a memory of the tag, such as memory 222 of tag 200 in FIG. 2 may be transmitted back to the controller 200 to indicate if an alarm condition exits, or as previously discussed, if no return status signal is received because the tag is out of range, the processor 308 may determine that an alarm condition exists and activate the audio alarm 320 and present a visual alarm on display 334.

Figure 4A:
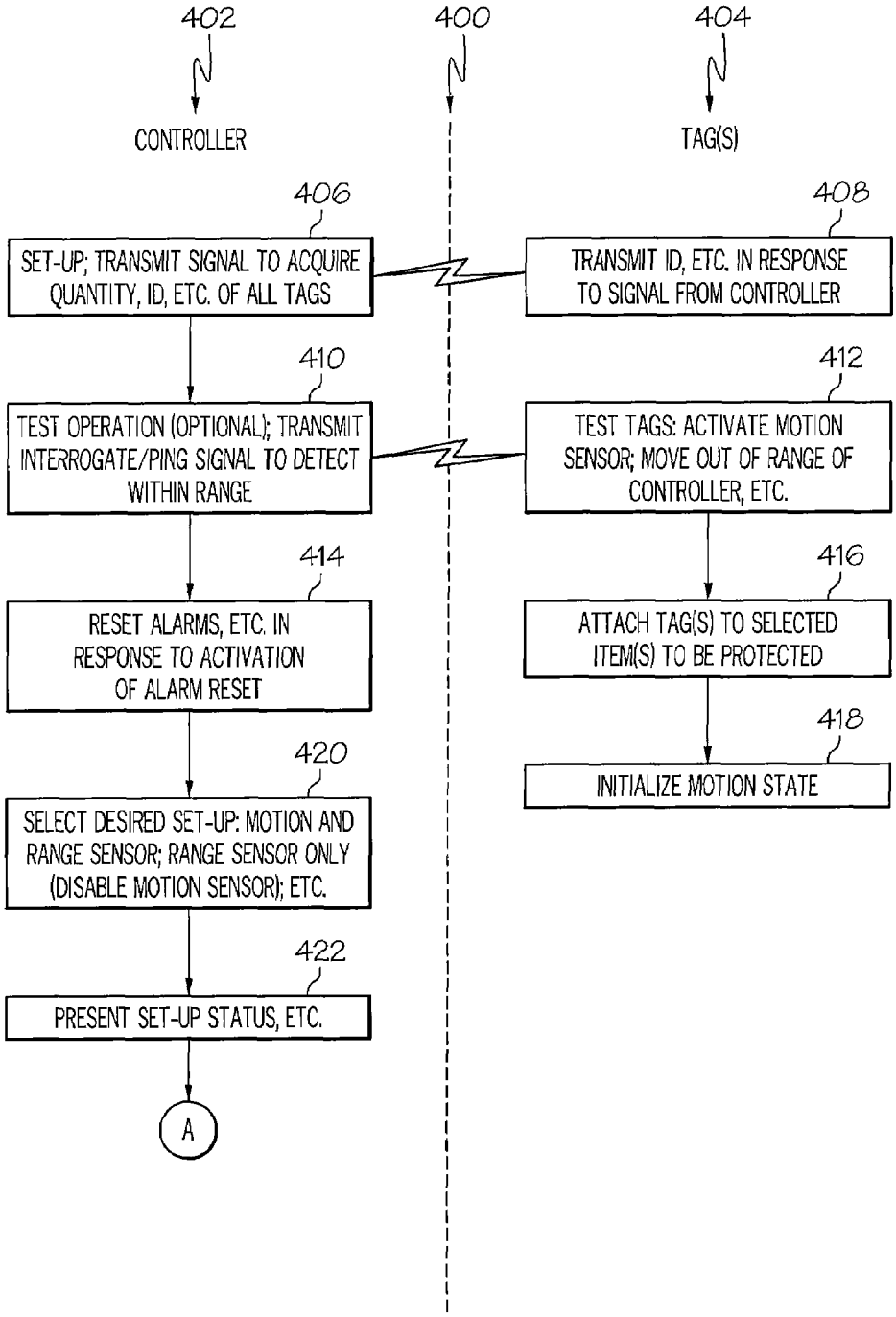
FIGS. 4A and 4B (collectively FIG. 4) are a flow chart of an example of a method to protect personal property in accordance with an embodiment of the present invention.
Figure 4B:
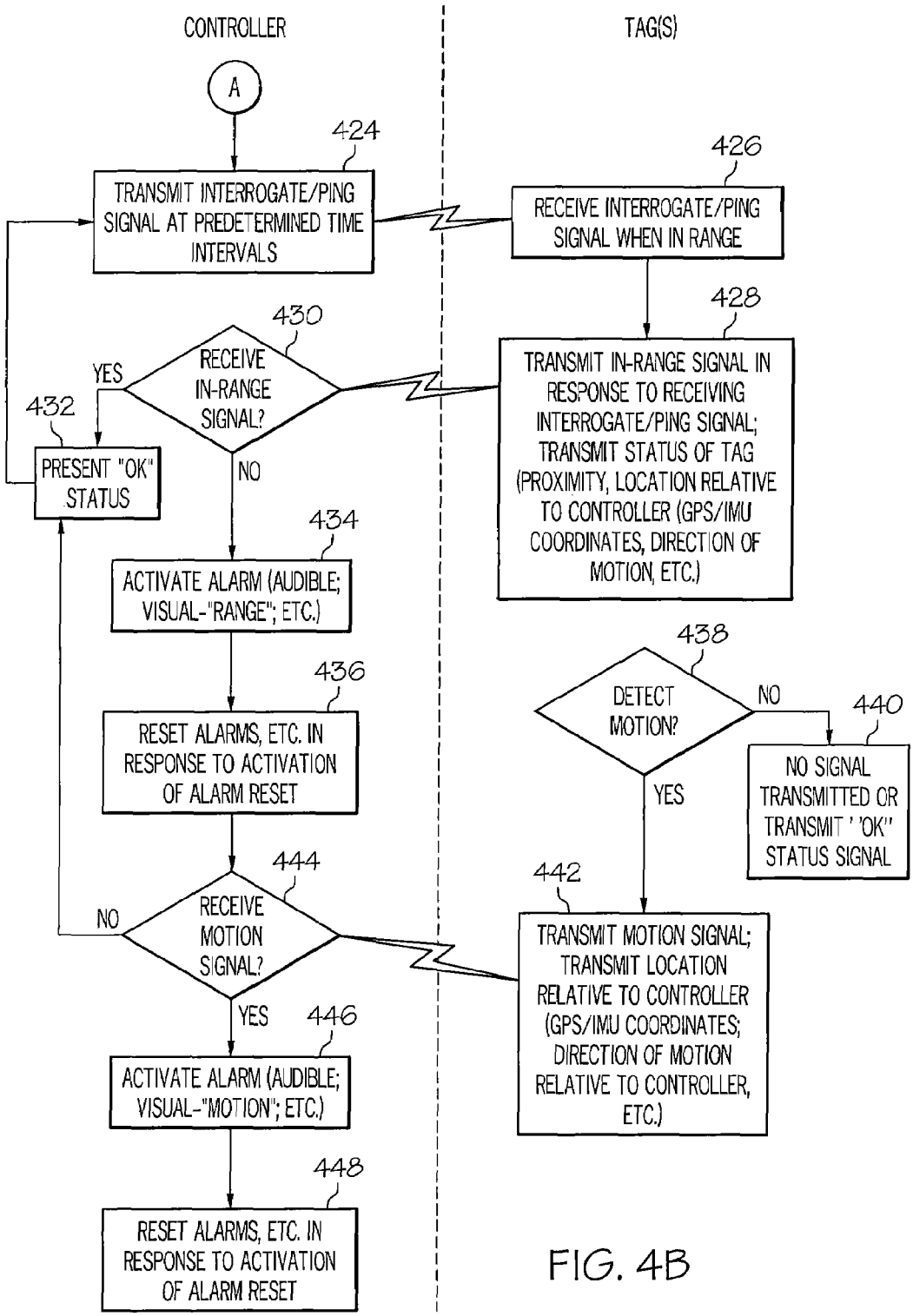

FIGS. 4A and 4B (collectively FIG. 4) are a flow chart of an example of a method 400 to protect personal property in accordance with an embodiment of the present invention. The method 400 may be embodied in a system for protecting personal items or the like, such as the system 100 in FIG. 1. As illustrated in FIG. 4, the method 400 may be divided into functions or operation that may be embodied in and performed by a controller 402, such as controller 108 of FIG. 1 or controller 300 of FIG. 3, and functions or operations that may be embodied in and performed by an electronic tag 404, such as electronic tag 104 of FIG. 1 or electronic tag 200 of FIG. 2.

In block 406, a set-up process may be performed by the controller 402. The set-up process may be performed in response to a user activating a set-up switch or the like, such as "SET-UP" switch or button 328 of the controller 300 in FIG. 3. The set-up process may include transmitting a signal to each tag to a acquire a quantity of tags, an identification (ID) code of each tag, a current status of each tag and any other information that may be appropriate or necessary for setting up the system for protecting personal property items. The system may be initialized by the user placing each tag to be associated with a personal property item proximate to the controller. The user may then operate the set-up button or switch, such as "SET-UP" switch or button 328 (FIG. 3) to alert the controller to monitor this tag or tags.

In block 408, each tag may transmit its ID code, current status or the like to the controller in response to the set-up signal from the controller. The ID code may be pre-loaded on the tag by the manufacturer, or in another embodiment of the present invention, the user may be able to program the ID code for each tag. For example, a controller, similar to controller 300 of FIG. 3 may include a keypad to permit a user to enter an ID code that may be transmitted to a selected tag to program the ID code into the selected tag.

In blocks 410 and 412, operation of the system or operation of each tag may be tested. This may be an optional operation. The system or each tag may be tested by transmitting an interrogation signal or ping signal to each tag to detect whether the tag is within range to detect the signal. In block 412 the tag may be moved to activate the motion sensor, GPS, IMU or similar device. The tag may also be moved out of range of the controller to test the ability of the controller to sense or detect that the tag is out of range and to provide the appropriate alarm indications.

In block 414, the alarm or alarms, such as audio and visual alarms may be reset in response to activating a reset switch or button, such as reset 330 in FIG. 3. In block 416, the electronic tag or tags may be associated or otherwise attached to selected items to be protected. In block 418, the motion state of each tag may be initialized so that any change in state or condition will cause a motion bit to be set in memory of the tag and/or a signal to be sent to the controller automatically or in response to a periodic ping or interrogation signal from the controller.

In block 420, a desired set-up or operational mode may be selected. For example, both motion and range sensors may be active, only the range sensor may be set and the motion sensor may be disabled or some other mode of operation may be selected. The motion sensor or detection feature may be disabled by activating a disable motion switch or button, such as "DISABLE MOTION" button 332 of FIG. 3, similar to that previously described. The range or out-of-range mode or feature may still be active for detecting if the item associated with the tag is moved beyond a predetermined range from the controller, such as about 10 to about 20 feet from the controller. In block 422, the present or current set-up status or operational mode may be presented or displayed to a user. A current status of each electronic tag may also be presented or displayed as well as any other information relative to operation of the system.

In block 424, an interrogate or ping signal may be transmitted to each associated electronic tag at predetermined time intervals. In block 426, the interrogate or ping signal may be received if the tag is within range. In block 428, an in-range signal may be transmitted by the tag to the controller in response to the tag receiving the interrogate or ping signal. A status of the tag may be transmitted to the controller in response to the interrogate or ping signal. As previously described, the status may include a proximity of the electronic tag to the controller, a location of the electronic tag relative to the controller, coordinates of the electronic tag as may be provided by a GPS, IMU or similar device included as a component of the tag, a direction of motion of the electronic tag relative to the controller, an indication that the tag is okay and there is no alarm condition, or other status information. The tag may fail to send a return signal or a return status signal in response to being out of range of the controller, as may be the case if the item associated with the tag has been lost or stolen.

In block 430, a determination may be made if the controller received an in-range signal or status signal from the associated tag currently being pinged or interrogated. If the in-range signal or status signal is received in block 430 an "OK" status or similar indication may be presented to the user by the controller in block 432 and the method 400 may return to block 424 and the method 400 may proceed as previously described. The "OK" status indication may be presented on a display of the controller, such as the display 334 of the exemplary controller 300 in FIG. 3.

If a determination is made in block 430 that an in-range signal or status signal was not received, the method 400 may advance to block 434. In block 434, an alarm may be activated. The alarm may be an audible alarm, a visual alarm or both. The audible alarm may involve generating an audible sound by an alarm device, such as the auditory device or speaker 320 in FIG. 3. The visual alarm or alert may involve flashing a light on the controller and/or presenting a message, such as "RANGE" in a display of the controller, such as display 334 of FIG. 3.

In block 436, the alarm or alarms may be reset in response to activation of an alarm reset, such as "RESET" switch or button 330 of the controller 300 in FIG. 3 or a similar reset means. While not shown in FIG. 4, the method 400 may then return to block 424 and the method 400 may continue as previously described.

In block 438, a determination may be made if motion is detected in one of the tags associated with the controller. If no motion is detected, the method 400 may advance to block 440 and no signal may be transmitted to the controller or an "OK" signal or similar indication may be transmitted. The signal may be transmitted in response to an interrogation or ping signal from the controller.

If motion of the tag is detected in block 438, the method 400 may advance to block 442. In block 442, a motion signal, motion detected signal or the like may be transmitted to the controller. The tag may also transmit a location of the tag relative to the controller, GPS/IMU coordinates, direction of motion of the tag relative to the controller or other status information.

In block 444, a determination may be made if a motion signal or other status information signal indicating unauthorized movement of the tag has been received by the controller. If no motion signal has been received or a signal indicating that the status of the tag is okay, the method 400 may advance to block 432 and the "OK" status or similar indication may be presented. The method may then proceed as previously described.

If a motion signal is received in block 444 indicating that the tag has been moved or is being moved, the method 400 may advance to block 446. In block 446, an alarm may be activated. The alarm may be an audio alarm, a visual alarm or both. The audio alarm may involve generation of a audible signal by a device, such as audio device or speaker 320. The visual alarm may involve illumination or flashing of a light on the controller and/or presentation of a message, such as "MOTION" or a similar indication on a display of the controller, such as display 334 in FIG. 3.

In block 448, the alarm or alarms may be reset in response to activation of an alarm reset means, such as "RESET" switch or button 330 in FIG. 3 or similar reset means. While not shown in FIG. 4, the method 400 may return to block 424 after a reset and the method 400 may proceed as previously described. The in-range detection features and motion detection features illustrated in FIG. 4 are not intended to operate in any particular order relative to one another and may operate simultaneously with one another.

The controller or functions of the controller may be embodied in commercial electronic devices, such as a personal digital assistant (e.g., Palm Pilot, Blackberry, etc.) a cellular telephone or other wireless communications device.

The flowcharts and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A system to protect personal property, comprising:

an electronic tag associable with a personal property item, wherein the electronic tag comprises:

a Global Positioning System and an Inertial Measurement Unit to determine a coordinate location of the electronic tag, wherein the electronic tag comprises the Global Positioning System;

a communications device to transmit a signal to a controller, wherein the signal includes the coordinate location of the electronic tag; and a motion sensor to detect any motion of an associated personal property item, wherein the controller comprises means for selecting operation between a combination motion sensor and range sensor mode, only in a range sensor mode for sensing a range of the electronic tag and personal property from the controller, and only in a motion sensor mode to sense movement of the electronic tag and the personal property;

wherein the communications device transmits a signal to the controller in response to any motion of the personal property and associated electronic tag being detected, the controller including a disable motion button or switch, wherein any signal received by the controller from the electronic tag in response to motion being detected by the electronic tag is ignored when the disable motion button or switch is active, or the controller sends a disable motion signal to the electronic tag to disable the motion sensor in response to the disable motion button or switch being active.

2. The system of claim 1, wherein the electronic tag comprises a unique identification code to distinguish the electronic tag from other electronic tags.

3. The system of claim 1, wherein the electronic tag comprises a device to determine a status of the electronic tag.

4. The system of claim 1, wherein the electronic tag comprises a device to report a status of the electronic tag to the controller.

5. The system of claim 1, wherein the electronic tag comprises a device to determine at least one of a group including a proximity of the electronic tag to the controller, the electronic tag being out of communications range of the controller, motion of the electronic tag, a direction of motion of the electronic tag and a location of the electronic tag.

6. The system of claim 1, wherein the electronic tag comprises one of a radio frequency identification (RFID) tag, Bluetooth-type transceiver, ultrasonic transceiver and an infrared transceiver to communicate with the controller.

7. The system of claim 1, wherein the electronic tag comprises a memory to store a unique identification code to distinguish the electronic tag from other electronic tags and to store information related to a status of the electronic tag.

8. The system of claim 1, wherein the electronic tag comprises:

an antenna to receive a signal from the controller to power the electronic tag to perform predetermined operations; and another antenna connected to the communications device for sending and receiving communications signals.

9. The system of claim 1, wherein the communications device transmits a status of the electronic tag via a satellite.

10. The system of claim 1, wherein the controller comprises a processor to determine a status of the electronic tag based on information from the electronic tag.

11. The system of claim 1, wherein the controller comprises a processor to determine a status of the electronic tag in response to at least one of a signal received from the electronic tag or absence of a signal from the electronic tag after an interrogation signal.

12. The system of claim 1, wherein the controller comprises at least one of an audible alarm and a visual alarm to alert a user about a status of the electronic tag.

13. The system of claim 1, wherein the controller comprises a display to present a status of the electronic tag.

14. The system of claim 13, wherein the status of the electronic tag comprising at least one of a range indication of the electronic tag, a location of the electronic tag, a direction of motion of the electronic tag.

15. The system of claim 1, wherein the controller comprises one of an RFID reader, Bluetooth-type transceiver, ultrasonic transceiver and an infrared transceiver to communicate with the electronic tag.

16. The system of claim 1, wherein the controller comprises a module to access a stored status of the electronic tag to determine if an alarm condition exists.

17. The system of claim 1, wherein the controller is embodied in at least one of a portable computing device, handheld computing device, and a mobile communications device.

18. An electronic tag for use in a personal property protection system, comprising:

a unique identification code to distinguish the electronic tag from other electronic tags;

a component to determine a status of the electronic tag;

a motion sensor to detect any motion of an associated personal property item;

a Global Positioning System (GPS) and an Inertial Measurement Unit (IMU) to determine a coordinate location of the electronic tag, wherein the personal property protection system is selectively operable in a combination motion sensor and range sensor mode, only in a range sensor mode for sensing a range of the electronic tag and personal property from a controller, and only in a motion sensor mode to sense movement of the electronic tag and the personal property; and a communications device to report a status of the electronic tag to a controller in response to detecting any motion and information from the at least one GPS and IMU, wherein the controller comprises a disable motion button or switch to ignore any signal received by the controller from the electronic tag in response to motion being detected by the electronic tag when the disable motion button or switch is active, or the controller being adapted to send a disable motion signal to the electronic tag to disable the motion sensor in response to the disable motion button or switch being active.

19. The electronic tag of claim 18, further comprising a component to determine at least one of a group including a proximity of the electronic tag to the controller, that the electronic tag is out of range of the controller, motion of the electronic tag, a direction of motion of the electronic tag and a location of the electronic tag.

20. The electronic tag of claim 18, further comprising one of a radio frequency identification (RFID) tag, Bluetooth-type transceiver, ultrasonic transceiver and an infrared transceiver to communicate with the controller.

21. A method to protect personal property, comprising:

selecting operation between a combination motion sensor and range sensor mode, only in a range sensor mode for sensing a range of a electronic tag and personal property from a controller, and only in a motion sensor mode to sense movement of the electronic tag and the personal property;

determining a status of an electronic tag associated with a personal property item;

transmitting an interrogate or ping signal to the electronic tag at predetermined time intervals;

receiving an in-range signal from the electronic tag in response to the electronic tag being in-range and the electronic tag receiving the interrogate or ping signal;

activating an alarm in response to the status of the electronic tag being in a predetermined condition; and ignoring an alarm signal received by a controller in response to a disable motion button or switch on the controller being active, wherein the alarm signal is sent by the electronic tag in response to the electronic tag detecting motion.

22. The method of claim 21, wherein determining the status of the electronic tag comprises at least one:

detecting motion of the electronic tag;

determining that the electronic tag is beyond a range of communications of a controller;

determining a proximity of the electronic tag to the controller;

determining a direction of motion of the electronic tag;

determining a location of the electronic tag.

23. The method of claim 21, further comprising reporting a status of the electronic tag to a controller.

24. The method of claim 21, further comprising reporting a status of the electronic tag via a satellite.

25. The method of claim 21, further comprising storing a unique identification code of each electronic tag in a personal property protection system.

26. The method of claim 21, further comprising accessing a stored status of the electronic tag to determine if an alarm condition exits.

27. A computer program product to protect personal property from theft or loss, the computer program product comprising:

a computer usable medium having computer usable program code embodied therewith, the computer usable medium comprising:

computer usable program code configured to select operation between a combination motion sensor and range sensor mode, only in a range sensor mode for sensing a range of a electronic tag and personal property from a controller, and only in a motion sensor mode to sense movement of the electronic tag and the personal property;

computer usable program code configured to determine a status of an electronic tag associated with a personal property item;

computer usable program code configured to transmit an interrogate or ping signal to the electronic tag at predetermined time intervals;

computer usable program code configured to receive an in-range signal from the electronic tag in response to the electronic tag being in-range and the electronic tag receiving the interrogate or ping signal;

computer usable program code configured to activate an alarm in response to the status of the electronic tag being in a predetermined condition; and computer usable program code configured:

to permit deactivation of an alarm signal in a controller in response to a signal from the electronic tag caused by motion of the electronic tag being received by the controller and a disable motion button or switch on the controller being active, or to transmit a disable motion signal from the controller to the electronic tag to disable a motion sensor in the electronic tag in response to the disable motion button or switch on the controller being active.

28. The computer program product of claim 27, further comprising computer usable program code configured to at least one of:

detect motion of the electronic tag;

determine that the electronic tag is beyond a range of communications of a controller;

determine a proximity of the electronic tag to the controller;

determine a direction of motion of the electronic tag;

determine a location of the electronic tag.

29. The computer program product of claim 27, further comprising computer usable program code configured to report a status of the electronic tag to a controller.

30. The computer program product of claim 27, further comprising computer usable program code configured to access a stored status of the electronic tag to determine if an alarm condition exits.

* * * * *